US005944270A

United States Patent [19]

Farris

[11] Patent Number: 5,944,270

[45] Date of Patent: Aug. 31, 1999

[54] SELF-CONTAINED AIR SEAL ASSEMBLY FOR COAL PULVERIZER

[75] Inventor: Lawrence S. Farris, East Granby, Conn.

[73] Assignee: Combustion Engineering, Inc., Windsor, Conn.

[21] Appl. No.: 09/105,835

[22] Filed: Jun. 26, 1998

[51] Int. Cl.[6] ..... B02C 9/04

[52] U.S. Cl. ..... 241/119

[58] Field of Search ..... 241/57, 119, 121

[56] References Cited

U.S. PATENT DOCUMENTS

| | | | |
|---|---|---|---|
| 2,689,689 | 9/1954 | Engler | 241/121 |
| 2,909,330 | 10/1959 | Hardinge | 241/19 |
| 3,199,797 | 8/1965 | Eft et al. | 241/117 |
| 4,441,720 | 4/1984 | Dibowski et al. | 241/431 |
| 4,789,105 | 12/1988 | Hosokawa et al. | 241/67 |
| 5,295,629 | 3/1994 | Satake et al. | 241/57 |

*Primary Examiner*—Joseph J. Hail, III
*Assistant Examiner*—Susan R. Kingsbury
*Attorney, Agent, or Firm*—Russell W. Warnock

[57] ABSTRACT

A bowl mill having a separator body, a grinding table and a plurality of grinding rolls for exerting grinding forces on material to be ground is provided with a plenum and a vane assembly for controlling the pressure conditions in the separator body. The vane assembly includes a plurality of vanes which rotate within the plenum to propel air from the plenum into an upper region of the separator body. This arrangement prevents or minimizes the penetration or migration of ground material into a lower region of the separator body of the bowl mill.

14 Claims, 5 Drawing Sheets

SELF-CONTAINED AIR SEAL ASSEMBLY FOR COAL PULVERIZER

BACKGROUND OF THE INVENTION

It is known that a range of materials such as foodstuffs, and agricultural products and fossil fuels including coal, may be pulverized in a pulverizing operation performed by a bowl mill. A bowl mill, in one typical configuration, includes a separator body and a grinding table. The grinding table is supported on the top axial end of a shaft for rotation within the separator body. Such a bowl mill also includes a plurality of grinding rolls supported within the separator body, each grinding roll being operable to exert a grinding force on the material to be pulverized which is disposed on the grinding table for effecting the pulverization thereof. The portion of the bowl mill comprising the grinding table and the grinding rolls can be viewed as an upper region of the bowl mill in which the feed of the material to be pulverized, the pulverization of the material, and the classification of the material is performed. In contrast, the portion of the bowl mill below the grinding table can be viewed as a lower region which includes the grinding table shaft and the shaft rotation drive assembly, typically in the form of a gear assembly and a drive motor.

In a negative pressure bowl mill operation, a gas stream typically comprised of heated outside air from a forced draft (FD) fan is drawn into the upper region of the bowl mill, typically by means of an exhauster. The exhauster is typically located downstream of the bowl mill. Under normal design operation, the upper housing is customarily at a pressure of between one and one half (1.5) to one half (0.5) inches of water less than the lower chamber. This airstream in the upper region of the bowl mill acts entrain individual pieces, including particles and larger pieces, of the material fed into the bowl mill and to transport these entrained pieces into engagement with a device for discriminating between those pieces which are sufficiently pulverized to be permitted to exit the bowl mill and those pieces which require further pulverization within the bowl mill; this discriminating device is frequently a rotating vane-type device known as a rotary classifier.

As noted, under normal design operation, the upper housing is customarily at a relatively lower pressure than the lower housing. Due to this normal operating condition, bowl mills designed for negative pressure operation have typically not been provided with an air seal system of the type often provided on mills designed for pressurized mill operation which require such an air seal system to maintain a separate pressurized region between the upper and lower regions. Accordingly, in bowl mills designed for negative pressure operation, the absence of an air seal system or some other seal system between the upper and lower regions effectively dictates that the upper housing pressure must be maintained at a negative pressure and, moreover, this negative pressure is the operating limit of the bowl mill.

The upper housing negative pressure operates as the operating limit because the coal grinding capacity of the bowl mill is restrained by the need to maintain the negative pressure regime although the bowl mill may be otherwise capable of handling an increased feed rate of coal. For example, if it is desired to increase the feed rate of coal, relatively more hot air is needed to dry and transport the additional coal. However, the exhauster typically cannot push this additional heated air, which is commonly provided via the forced draft (FD) fan, through the milling and fuel pipe system. Thus, when the coal feed rate is exceeded, the heated air is no longer moved through the upper housing at a rate sufficient to maintain a negative pressure regime in the upper housing. Instead, the heated air dwells in the upper housing and pressurizes it.

It can be appreciated that such a positive pressure regime in the upper region of the bowl mill will negatively promote the transport or migration of feed material pieces such as, for example, pulverized coal particles, into the lower region of the bowl mill and this is an undesirable consequence in view of the presence of rotating and lubricated parts in the lower region of the bowl mill. These lower region parts such as, for example, the gear drive assembly for driving the grinding table shaft, will suffer deteriorated performance as well as more frequent operational interruptions and breakdowns if beset by the material feed particles. Accordingly, the bowl mill design and operation should preferably be arranged to accommodate the positive pressure regime in the upper region so that the parts of the bowl mill in its lower region can optimally perform.

U.S. Pat. No. 4,441,720 discloses one approach for minimizing the intrusion of feed material particles into the bowl mill lower region. This patent discloses a barrier air chamber through which flows a barrier air at a pressure exceeding the pressure of the carrier gas in the upper region of the bowl mill. The barrier air is connected through a gap with the upper region and flows thereinto to prevent passage of the carrier gas together with coal dust into the lower region of the bowl mill. While this arrangement may demonstrate some efficacy in preventing penetration or migration of feed material particles into the lower region of the bowl mill, it can be appreciated that such an arrangement requires a separate forced air supply means and brings with it the usual maintenance requirements of any forced gas stream arrangement including seal maintenance and maintenance of the gas stream motive means (i.e., a fan motor). Accordingly, there is still a need for an arrangement which prevents or minimizes the penetration or migration of feed material into the lower region of a bowl mill which offers efficacy and reliability without necessitating relatively substantial maintenance and installation efforts.

SUMMARY OF THE INVENTION

The present invention provides an arrangement which prevents or minimizes the penetration or migration of feed material into the lower region of a bowl mill which offers efficacy and reliability without necessitating relatively substantial maintenance and installation efforts. In accordance with the present invention, there is provided a chamber sealing apparatus that is operable to prevent or mitigate the migration of fluids such as coal-laden air into a chamber or region of a bowl mill of the type operative for pulverizing material into smaller particles. The chamber sealing apparatus is more specifically operable in connection with a bowl mill having a separator body, a grinding table supported on a shaft for rotation within the separator body, at least one grinding roll supported within the separator body so as to be operable to exert a grinding force on material disposed on the grinding table for effecting the pulverization thereof.

In accordance with one operational possibility of the chamber sealing apparatus of the present invention, the chamber sealing apparatus is operable in a bowl mill separator body having an upper region in which the grinding table and the grinding rolls are located and in which an upper region pressure condition exists and a lower region separate from the upper region and having a lower pressure condition than the pressure condition of the upper region atmosphere.

According to one aspect of the chamber sealing apparatus of the present invention, there is provided means forming a plenum communicated with the upper and lower regions of the separator body of a bowl mill including means forming at least one inlet opening communicating the plenum and the lower region of the separator body and means forming at least one outlet opening communicating the plenum and the upper region of the separator body. The outlet opening forming means includes a shaft associated portion and a second portion spaced from the shaft associated portion to form the outlet opening therebetween.

A vane assembly is also provided and includes at least one vane and a vane support for supporting the vane for rotation about a vane axis, the vane assembly being disposed relative to the plenum for movement of the at least one vane within the plenum during rotation of the vane about the vane axis. The one aspect of the chamber sealing apparatus of the present invention further includes means interconnecting the vane assembly and a power source for rotatably driving the vane about the vane axis such that air in the plenum is subjected to a pressurization greater than that of the upper region of the separator body at the outlet opening, whereby the rotation of the vane within the plenum draws air from the lower region of the separator body into the plenum via the inlet opening and propels air from the plenum into the upper region of the separator body via the outlet opening.

In accordance with one variation of the one aspect of the chamber sealing apparatus of the present invention, the interconnecting means includes means coupling the vane support to the mill shaft for driving rotation of the vanes about the vane axis by the shaft. According to further features of the one variation of the one aspect of the chamber sealing apparatus of the present invention, the vane axis and the bowl mill shaft axis are the same and the vanes and the shaft co-axially rotate.

According to another variation of the one aspect of the chamber sealing apparatus of the present invention, the shaft associated portion of the outlet opening forming means is a circumferential flange extending radially outwardly from the shaft.

According to further details of this another variation of the one aspect of the chamber sealing apparatus of the present invention, the second portion of the outlet opening forming means includes means forming a surface having an edge extending circumferentially around the shaft at a radial spacing therefrom greater than the radial extent of the shaft associated portion whereby the outlet opening is formed between the edge and the shaft associated portion.

According to further details of each of the variations of the one aspect of the chamber sealing apparatus of the present invention, the shaft forms a portion of the plenum forming means. Additionally, the vane assembly can include a plurality of vanes and the vane support is operable to support the vanes in angularly spaced relation to one another about the vane axis, the vane assembly being disposed relative to the plenum for movement of the vanes within the plenum during rotation of the vanes about the vane axis. Moreover, the vane and the shaft associated portion of the outlet opening forming means can be integrally formed.

According to yet further details of each of the variations of the one aspect of the chamber sealing apparatus of the present invention, the shaft associated portion of the outlet opening forming means can move relative to the shaft. Also, the surface of the shaft can form the shaft associated portion of the outlet opening forming means of the plenum. Furthermore, the shaft associated portion may include an axial extent of the shaft. In contrast, the vane axis may be parallel to and radially offset from the shaft. According to additional details of this feature, the shaft is the power source and power take off means are provided for drivingly interconnecting the shaft and the vane support such that the vanes are drivingly rotated by the shaft.

DETAILED DESCRIPTION OF THE PREFERRED EMBODIMENTS

Figure 1:
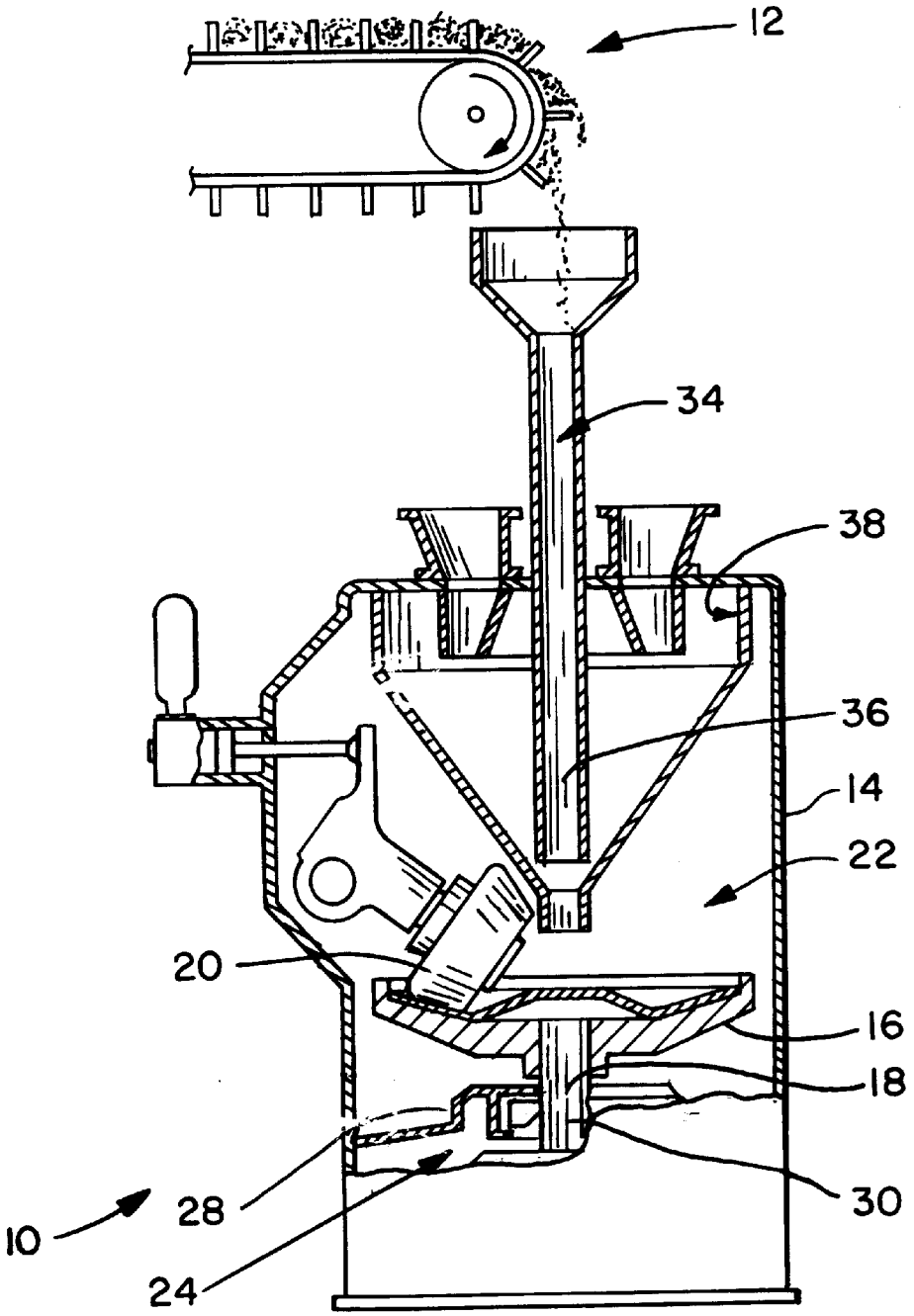
FIG. 1 is a front elevational view, in partial vertical section, of a bowl mill having a chamber sealing apparatus of the present invention.

Referring now to FIGS. 1–7, the preferred embodiments of the bowl mill and the bowl mill chamber sealing apparatus of the present invention are illustrated. As seen in FIG. 1, a pulverizing bowl mill 10 is operable to pulverize or grind coal on a grinding surface to thereby reduce the coal to a pulverized condition suitable for feeding to a coal-fired steam generator and the bowl mill 10 has cooperatively associated therewith a conventional coal or fossil fuel feeder means, here shown in exemplary fashion as a belt feeder device 12. As will be elaborated hereinafter, the pulverizing bowl mill 10 is equipped with a chamber sealing apparatus of the present invention for advantageously creating and maintaining a seal between respective chambers of the pulverizing bowl mill.

Referring more particularly to FIG. 1 of the drawings, the pulverizing bowl mill 10 includes a substantially closed separator body 14. A grinding table 16 is mounted on a shaft 18, which in turn is operatively connected to a suitable drive mechanism (not shown) so as to be capable of being rotatably driven thereby. A plurality of grinding rolls 20 are supported within the interior of the separator body 14 in an upper chamber 22 and the grinding rolls are spaced equidistantly from one another around the circumference of the grinding table 16.

With further regard to the grinding rolls 20, each grinding roll is supported on a suitable shaft (not shown) for rotation relative thereto and is supported relative to the grinding table 16 for pulverizing coal fed onto the grinding table 16.

The pulverizing bowl mill 10 also includes a lower chamber 24 which is located below the upper chamber 22 and is separated therefrom at an interface 26. The interface 26 extends between the upper chamber 22 and the lower chamber 24 at a circumferential extent of the cylindrical wall of the separator body 14 and is a physical barrier formed by an assembly of cooperatively configured components one of which is the chamber sealing apparatus of the present invention, generally designated as 28, and these cooperatively associated components forming the interface 26 act to prevent or sufficiently minimize the penetration or migration of certain fluid elements between the upper chamber 22 and the lower chamber 24 with the desirable consequence that the elements situated in the lower chamber 24, such as, for example, bearings, are protected from the deleterious effects of a fluid such as, for example, a gas (air) stream having entrained therewith feed material particles such as pulverized coal particles, which may penetrate or migrate from the upper chamber 22. The chamber sealing apparatus 28 of the present invention is particularly effective in minimizing or preventing the penetration or migration of coal-laden air from the upper chamber 22 into the lower chamber 24, thus producing the beneficial result that the rotating parts situated in the lower chamber 24 such as, for example, a main vertical shaft 30 on which the grinding table 16 is rotatably supported, and the parts cooperatively associated with the rotating parts such as, for example, a bearing assembly 32 which movably supports the main vertical shaft 30, are spared from the corrosive and operationally interfering effects of the coal-laden air.

Figure 2:
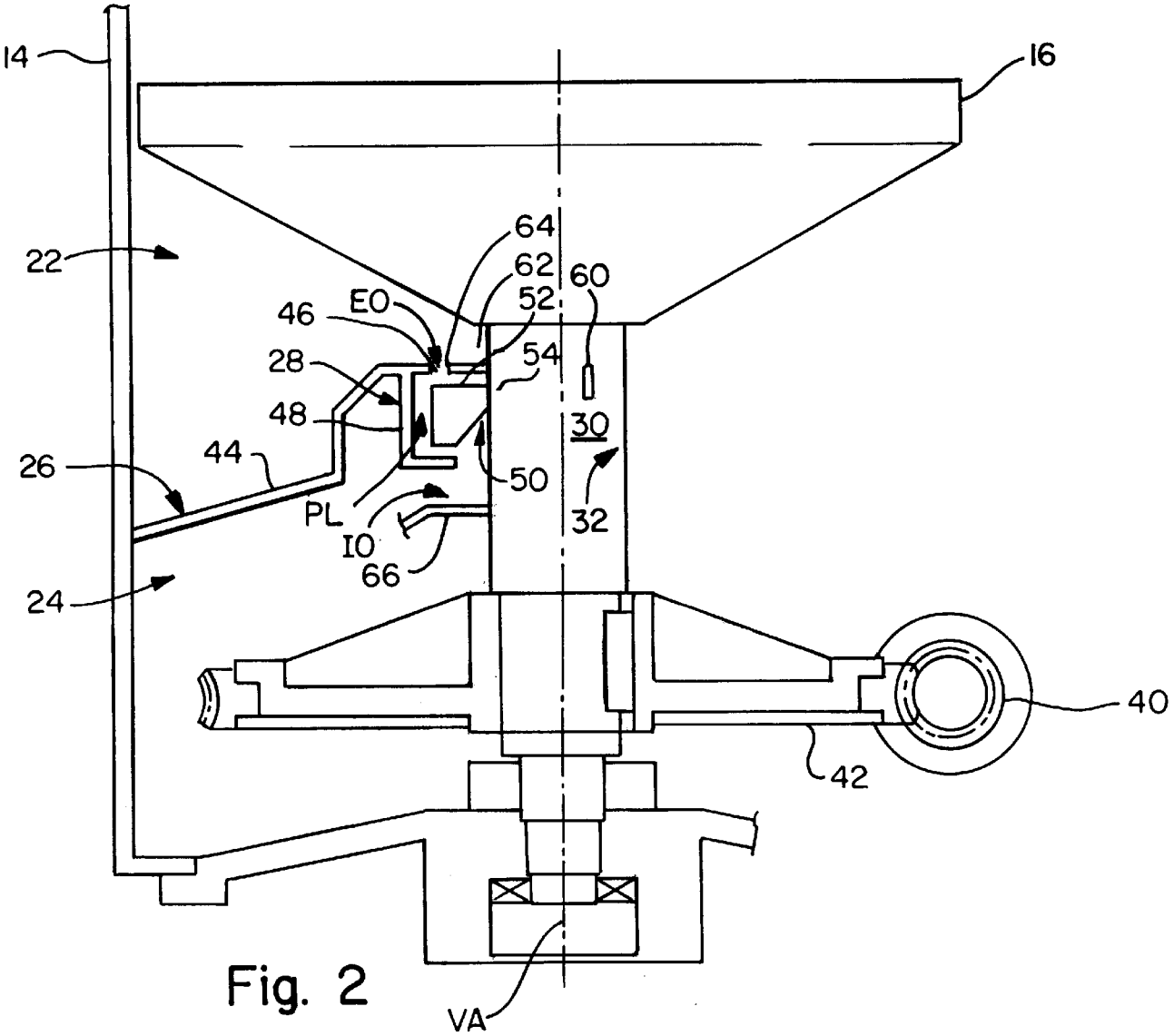
FIG. 2 is an enlarged front elevational view, in vertical section, of the lower chamber of the bowl mill shown in FIG. 1 and showing one embodiment of the chamber sealing apparatus of the present invention.
Figure 3:
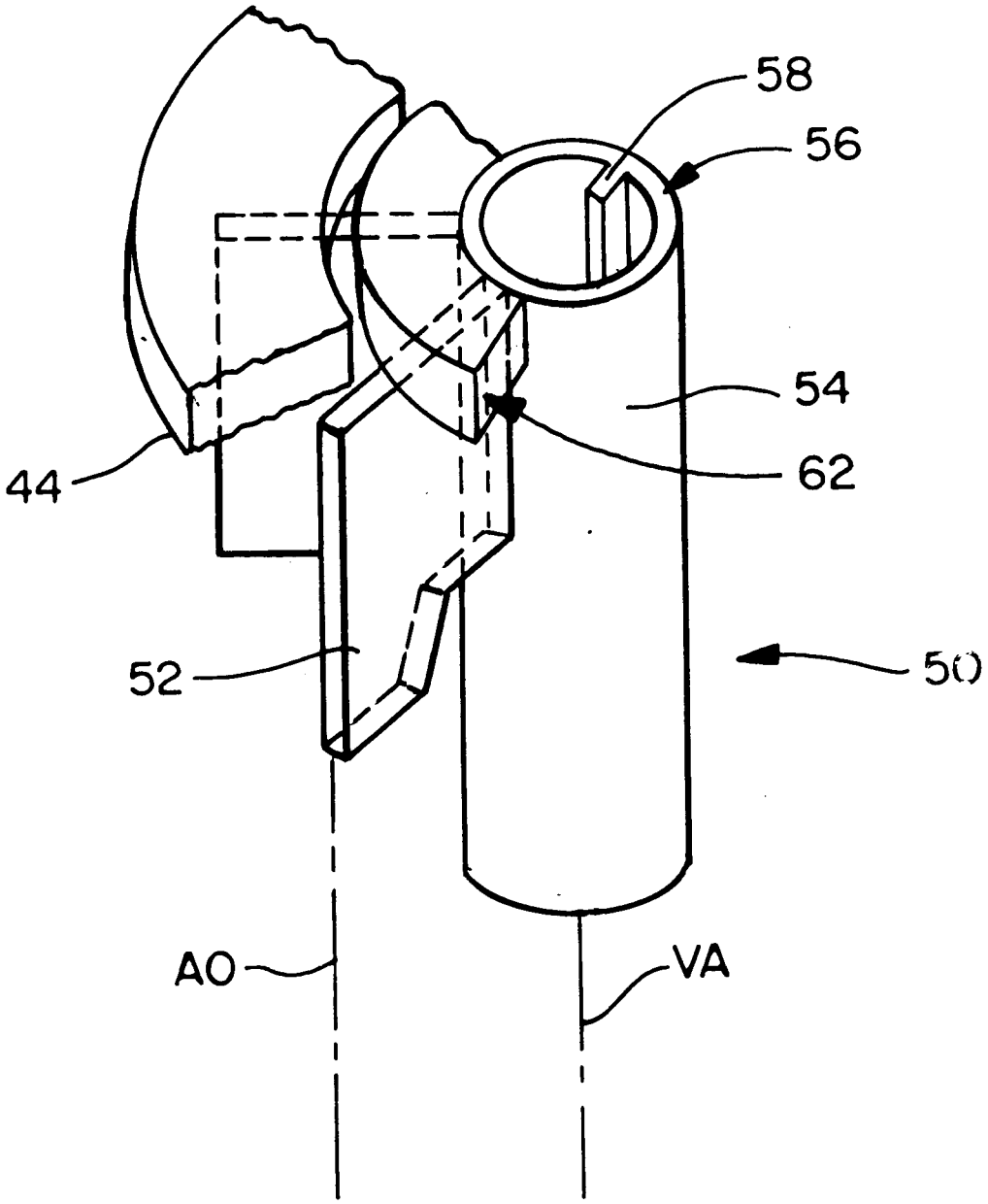
FIG. 3 is a perspective view of the one embodiment of the chamber sealing apparatus of the present invention shown in FIG. 2.

With particular reference now to FIGS. 2 and 3, one preferred embodiment of the chamber sealing apparatus 28 of the present invention will now be described in particular detail. However, to facilitate the hereinafter following description of the embodiments of the chamber sealing apparatus 28, an exemplary mode of operation of the pulverizing bowl mill 10 will first be described to facilitate an understanding of the nature of the deleterious fluid penetration and migration problem which the chamber sealing apparatus 28 advantageously mitigates. As seen in FIG. 1, in a customary mode of operation of the pulverizing bowl mill 10, a continuous yet adjustable feed of coal is fed by the belt feeder 12 into a coal supply means 34 which includes a suitably dimensioned duct 36 having one end proximate the grinding table 16. The coal thus fed into the duct 36 exits onto the grinding table 16. The coal on the grinding table 16 is subjected to a pulverizing action by virtue of the rotational movement of the grinding table 16 and the individual rolling actions of the grinding rolls 20 on the surface of the grinding table 16, with the coal being pulverized, i.e., crushed, between the rolling surfaces of the grinding rolls 20 and the grinding table 16.

During the pulverization process, the upper chamber 22 of the pulverizing bowl mill 10 is subjected to a continuous pressurization which may be at a value in the range of between about one inch of water to about five inches of water (inches WG). Accordingly, as the coal becomes pulverized, the coal particles created by the pulverization process are subjected to the forces created by the rotating action of the grinding table 16, the rotating actions of the grinding rolls 20, and the air flows (with entrained coal particles) created by the pressurizing atmosphere in the upper chamber 22. The centrifugal force created by the rotating action of the grinding table 16 urges the particles to move radially outwardly while this centrifugal force action is influenced and supplemented by the flow of the air and coal particles within the upper chamber 22 which has been influenced by the pressurization of the upper chamber 22.

Those coal particles which are entrained with the air circulating in the upper chamber 22 flow with the air to a classifier 38. The classifier 38, in accord with conventional practice and in a manner which is well known to those skilled in the art, operates to effect a further sorting of the coal particles that remain in the air stream. Specifically, those particles of pulverized coal, which are of the desired particle size, pass through the classifier 38 and along with the air are discharged therefrom and thereby from the pulverizing bowl mill 10. On the other hand, those coal particles which in size are larger than desired are returned to the surface of the grinding table 16 whereupon they undergo further pulverization. Thereafter, these coal particles are subjected to a repeat of the process just described. That is, the particles are thrown outwardly of the grinding table 16, are picked up by the air circulating in the upper chamber 22, and are carried along with the air to the classifier 38, with the heavier particles dropping back onto the grinding table 16 and the lighter particles being flowed after passage through the classifier 38 to exit the pulverizing bowl mill 10.

Returning now to FIG. 2, it can thus be appreciated that the air circulating in the upper chamber 22 of the separator body 14 continuously has entrained therewith particles of coal and, further, it can be appreciated that it would be deleterious to the optimum operation of the pulverizing bowl mill 10 if such coal particles were to penetrate or migrate into regions of the coal pulverizing mill 10 whereat moving parts are in contact with one another and/or are disposed in contact with a lubricant such as, for example, grease. Attention is drawn to the worm shaft assembly 40 of the conventional gear drive means for driving the driven gear 42 as an example of two such moving parts in the lower chamber 24 which are, as well, in contact with a lubricant. The driven gear 42 is co-axially mounted to the main vertical shaft 30 and is driven by a worm shaft (not shown) of the worm shaft assembly 40 to thereby drivingly rotate the main vertical shaft 30. The bearing assembly 32 comprises a radial bearing operable to support the main vertical shaft 30 for rotation thereof at an axial spacing from the driven gear 42 at a location intermediate the driven gear 42 and the grinding table 16 and is another example of such a moving part in the lower chamber 24.

In the one embodiment of the chamber sealing apparatus 28 of the present invention shown in FIG. 2, the chamber sealing apparatus is designed to completely form the interface 26 between the upper chamber 22 and the lower chamber 24 of the separator body 14 which, as noted above, prevents or mitigates the problem of intrusion of coal-laden air into the lower chamber 24. The chamber sealing apparatus 28 includes a skirt member 44 having an annular outer edge at the same diameter as the inner diameter of the separator body 14 at the location of the lower chamber 24. The outer annular edge of the skirt member 44 is circumferentially sealingly connected to the inner annular surface of cylindrical wall of the separator body 14 by a suitable mounting method—i.e., welding or the like. The skirt member 44 also includes an inner annular edge 46 having a diameter greater than the diameter of the main vertical shaft 30 and the skirt member 44 is supplementally supported by suitable mounting supports (not shown) or entirely by virtue of its mounting connection at its outer circumferential edge with the separator body 14 such that the inner circumferential edge 46 is supported co-axially with the main vertical shaft 30. The skirt member 44 additionally includes a flange 48 which will be described in more detail later.

The chamber sealing apparatus 28 also includes a vane assembly 50 which is preferably comprised of a plurality of vanes 52 commonly mounted to a vane support 54 for supporting the vanes 52 for rotation about a vane axis VA. In the embodiment illustrated in FIG. 2, the vane axis VA is the same as the axis of the main vertical shaft 30. The vanes 52 are circumferentially equidistantly spaced from one another about the vane axis VA. As seen in FIG. 3, each vane 52 is shaped with a relatively much larger radial and axial extent as compared to its annular extent (or thickness) and each vane 52 is fixedly mounted to the vane support 54 so as to be oriented at a prescribed angular orientation AO relative to the vane axis VA. In the embodiment of the chamber sealing apparatus 28 illustrated in FIGS. 2 and 3, each of the vanes 52 is supported at a vertical or parallel orientation relative to the vane axis VA—namely, an angular orientation of zero degrees. However, it is contemplated that one or all of the vanes 52 may be oriented at a different angular orientation AO relative to the vane axis VA with the angular orientation being selected so as to optimize or improve the fluid sealing characteristics of the chamber sealing apparatus 28. The angular orientation AO is measured as the angle between an axis passing through the respective vane 52 and the vane axis VA.

With further reference to FIG. 3, the chamber sealing apparatus 28 additionally includes means interconnecting the vane assembly 50 and a power source for rotatably driving the vanes 52 about the vane axis VA. In the one embodiment of the chamber sealing apparatus 28 illustrated in FIGS. 2 and 3, the interconnecting means is preferably in the form of a shaft mounting assembly 56 for fixedly mounting the vane assembly 50 to the main vertical shaft 30. The shaft mounting assembly 56 includes an axially extending key 58, as seen in FIG. 3, configured to be received in a correspondingly dimensioned keyway 60 on the main vertical shaft 30, as seen in FIG. 2. The vane support 54 can thus be fixedly mounted to the main vertical shaft 30 for rotation therewith by a combination of the receipt of the key 58 of the shaft assembly 56 into the keyway 60 on the main vertical shaft 30 and suitable fixed securement via, for example, welding or press fitting. In such an embodiment of the chamber sealing apparatus 28 in which the vane assembly is coupled to the main vertical shaft 30 for rotation therewith, the power source for rotatably driving the vanes 52 is consequently the power source which rotatably drives the main vertical shaft 30—i.e., the worm shaft assembly 40.

Additional elements of the one embodiment of the chamber sealing apparatus 28 can be seen in FIG. 2 and include a shaft skirt 62 fixedly mounted to the main vertical shaft 30 and extending radially outwardly therefrom to an outer annular edge 64 having a diameter less than the diameter of the inner edge 46 of the skirt member 44 such that an annular gap is formed between these two edges. The shaft skirt 62 is in the shape of an annular plate extending perpendicularly to the main vertical shaft 30 and fixedly mounted thereto via, for example, welding and the shaft skirt 62 is axially located relative to the main vertical shaft such that its outer edge 64 is at the same axial location as the inner edge 46 of the skirt member 44.

The chamber sealing apparatus 28 further includes a bottom shaft flange 66 which is preferably in the form of an annular plate fixedly secured to the main vertical shaft 30 and extending perpendicularly therefrom at an axial location thereon such that the bottom shaft flange 66 extends axially below the bottom edge of the flange 48 of the skirt member 44.

In accordance with the present invention, the flange 48 of the skirt member 44, the shaft skirt 62 and the bottom shaft skirt 66, together with the main vertical shaft 30, collectively form a plenum forming means defining a plenum PL dimensioned in accordance with the rotational path of vanes 52 which is described by the vanes 52 as they are rotatably moved by the motive power of the main vertical shaft 30. The plenum PL thus formed, as seen in FIG. 2, includes at least one outlet or exit opening EO communicating the plenum PL and the upper chamber 22 and which is the annular gap formed between the inner annular edge 46 of the skirt 44 and the outer annular edge 64 of the shaft skirt 62. The spacing between the bottom flange 48 and the bottom shaft flange 66 forms an inlet opening IO of the plenum PL for communicating the plenum with the balance of the lower chamber 24.

Accordingly, it can be seen that the plenum PL communicates with the upper chamber 22 and the lower chamber 24 and includes an inlet opening IO communicating with the lower chamber 24 of the separator body 24 and an outlet opening EO communicating with the upper chamber 22 of the separator body 14. Moreover, the outlet opening forming structure forming the outlet opening EO includes a shaft associated portion in the form of the shaft skirt 62 and a second portion spaced from the shaft associated portion in the form of the skirt 44. It can also be seen that the plenum PL is dimensioned so as to have an interior volume of sufficient size for free passage therethrough of the vanes 52 during their rotation. Namely, the flange 48 of the skirt member 44 is disposed at a radial spacing relative to the axis of the main vertical shaft 30 greater than the radial extent of the vanes 52 and the axial extent of the vanes 52 is less than the axial spacing of the lower edge of the flange 48 and the top of the plenum PL as formed by the skirt member 44 and the shaft skirt 62.

As seen in FIG. 2, the interface 26, arbitrarily defined as the interface between the upper chamber 22 and the lower chamber 24, is formed by the components of the chamber sealing apparatus 28 in such a manner that fluid communication between the two chambers is possible only through the plenum PL. The purpose in so limiting the fluid communication between the two chambers will become clear as the movement of the vanes 52 within the plenum PL is now described. As noted, the vanes 52 are rotated by the vertical shaft 30 and the vanes thus rotate angularly within the plenum PL. Although the plenum PL is dimensioned so as to permit free rotational movement of the vanes 52, the interior volume of the plenum PL, in accordance with the present invention, is selected in correspondence with the dimensions of the vanes 52 such that the movement of the vanes 52 angularly through the plenum PL imparts a motive force on the fluid in the plenum PL characterized by at least a minimum velocity sufficient to propel fluid (air) within the plenum through the exit opening EO. In other words, the vanes 52 and the plenum PL are configured to operate in a similar manner to a fan rotating within a fan housing to produce a fluid motive effect by which fluid such as air is accelerated upon contact with the rotating vanes. While the present invention contemplates that the volume circumscribed by the rotating vanes 52 may comprise a relatively small or a relatively large percentage of the interior volume of the plenum PL, the present invention comprehends any suitable volume relationship which permits the vanes 52 and the plenum PL to cooperate together in a fan and fan housing manner so as to impart motive force to the fluid therein.

Preferably, the vanes 52 are rotated at a rotational speed (revolutions per minute or RPM) sufficient to create a pressure in the lower chamber 24 which is at least one-half (0.5) inch of water (inches WG) greater than in the pressure in the upper chamber 22. For example, if the pressure in the upper chamber 22 is three (3) inches of water, then the pressure in the lower chamber 24 should preferably be three and one half (3.5) inches of water or greater to prevent blowdown of dust and other debris into the lower chamber 24.

Figure 4:
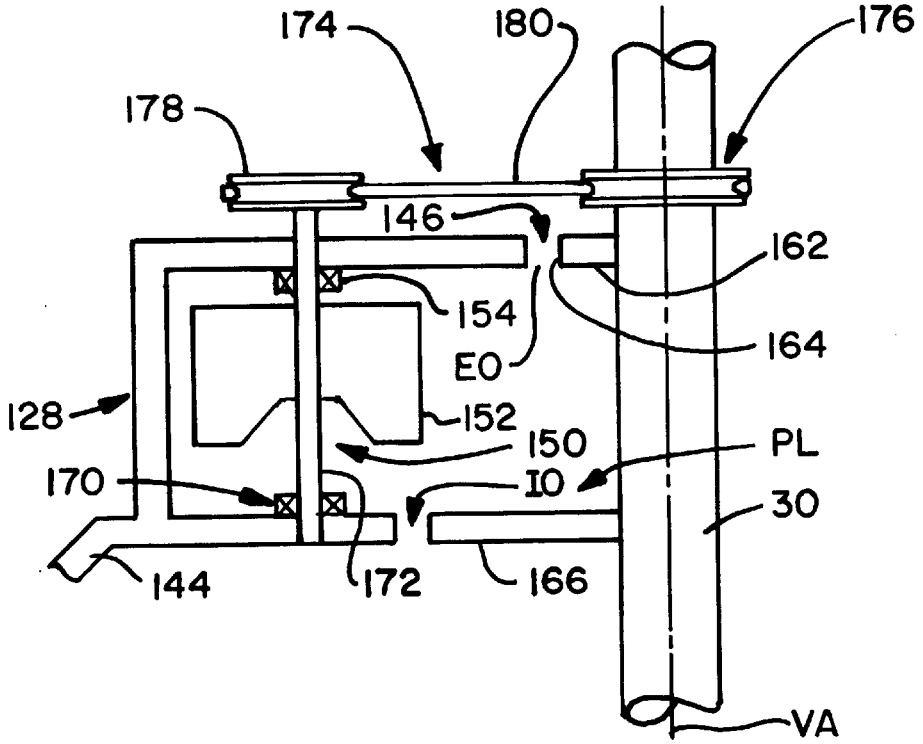
FIG. 4 is a front elevational view, in partial vertical section, of another embodiment of the chamber sealing apparatus of the present invention.

As seen in FIG. 4, in another embodiment of the chamber sealing apparatus 28 of the present invention, the chamber sealing apparatus 128 includes a skirt member 144 having an annular outer edge sealingly connected to the separator 14 and an inner annular edge 146. Also, this another embodiment of the chamber sealing apparatus 128 includes a shaft skirt 162 having an outer annular edge 164 with a diameter less than the diameter of the inner annular edge 146 of the skirt member 144, as measured relative to the axis of the main vertical shaft 30. Thus, the outlet opening EO of the plenum PL is created in the annular gap between the outer edge 164 of the shaft skirt 162 and the inner edge 146 of the skirt member 144. The inlet opening IO communicating the plenum PL with the balance of the lower chamber 24 is formed between a bottom shaft skirt 166 in the form of an annular plate sealingly mounted to the main vertical shaft 30 and a flange of the skirt member 144.

In the another embodiment of the chamber sealing apparatus 128 shown in FIG. 4, a vane assembly 150 includes a plurality of vanes 152 spaced from one another equidistantly about the vane axis VA on a vane support 154 which includes a pair of bearing assemblies 170 and a vane shaft 172 on which the vanes 152 are fixedly mounted. The vane shaft 172 is rotatably supported by the skirt member 144 at a radial spacing from the main vertical shaft 30 such that the vane axis VA is parallel to the axis of the main vertical shaft 30. In this embodiment of the chamber sealing apparatus 128, the means interconnecting the vane assembly 150 and a power source for rotatably driving the vanes 152 is preferably in the form of a power take off assembly 174 which includes a pulley 176 fixedly mounted to the main vertical shaft 30 for rotation therewith and a driven pulley 178 fixedly mounted co-axially to the vane shaft 172. A pulley belt 180 is trained around the shaft pulley 176 and the driven pulley 178 for driving rotation of the vane shaft 172 by the rotation of the main vertical shaft 30.

Figure 5:
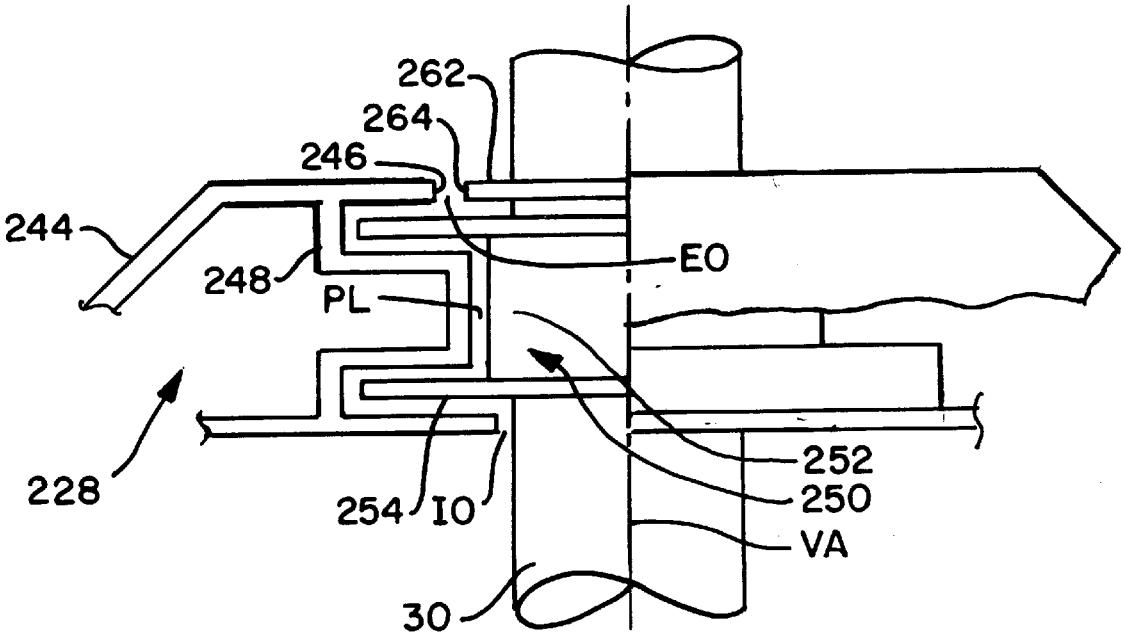
FIG. 5 is a front elevational view, in partial vertical section, of an additional embodiment of the chamber sealing apparatus of the present invention.

In FIG. 5, a further embodiment of the chamber sealing apparatus of the present invention is illustrated and generally designated as a chamber sealing apparatus 228. The chamber sealing apparatus 228 includes a skirt member 244 having an annular outer edge sealingly connected to the separator body 14 and having an annular inner edge 246. The skirt member 244 includes a flange 248 having a U-shaped cross section. The chamber sealing apparatus 228 includes a vane assembly 250 comprising a pair of 252 each mounted to a vane support 254 for supporting the vanes for rotation about the vane axis VA, which is shown by way of example as being the same as the axis of the main vertical shaft although it is understood that the vane axis VA can be, as illustrated with respect to the another embodiment shown in FIG. 4, offset from the axis of the main vertical shaft 30. Each of the vanes 252 is configured as a circular plate having a relatively much greater radial and angular extent than its axial (or height) extent and the pair of vanes 252 are mounted at an axial spacing from one another selected such that one respective vane 252 is free to rotate in a respective region above the U-shaped cross sectional portion of the skirt member 244 and the other vane 252 rotates in another respective region below the U-shaped section.

The further embodiment of the chamber sealing apparatus 228 shown in FIG. 5 additionally includes a shaft skirt 262 having an outer annular edge 264 of a diameter slightly less than the diameter of the inner annular edge 246 of the skirt member 244 so as to form therebetween an annular outlet opening EO. The skirt member 244 extends at a lower edge of the flange 248 to a lower inner annular edge having a diameter slightly greater than the diameter of the main vertical shaft 30 so as to form therebetween the annular inlet opening IO. Accordingly, it can be seen that the further embodiment of the chamber sealing apparatus 228 shown in FIG. 5 does not include a lower skirt member as does the another embodiment illustrated in FIG. 4 or the one embodiment illustrated in FIGS. 2 and 3.

Figure 6:
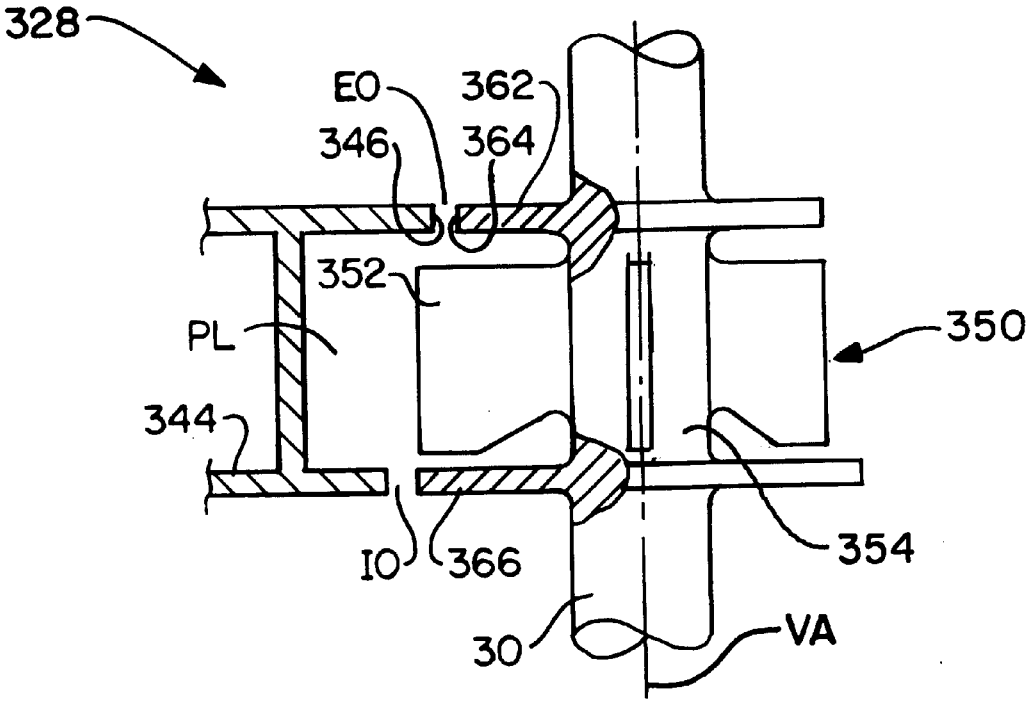
FIG. 6 is a front elevational view, in partial vertical section, of a further embodiment of the chamber sealing apparatus of the present invention.

In FIG. 6, an additional embodiment of the chamber sealing apparatus of the present invention is illustrated and is generally designated as a chamber sealing apparatus 328. The chamber sealing apparatus 328 includes a skirt member 344 having an annular outer edge sealingly connected to the separator body 14 and an annular inner edge 346. A shaft skirt 362 includes an outer annular edge 364 of a diameter of less than the inner edge 346 of the skirt member 344, whereby the annular gap formed between the edges forms the outlet opening EO of the plenum PL. The chamber ceiling apparatus 328 also includes a bottom shaft flange 366. The bottom shaft flange 366 and a bottom edge of the skirt member 344 form an inlet opening IO of the plenum PL for communicating the plenum with the lower chamber of the pulverizing bowl mill. A vane assembly 350 includes a plurality of vanes 352 commonly mounted to a vane support 354 which, in turn, is fixedly mounted to the shaft 30 for driving rotation of the vanes 352 about the vane axis VA.

Figure 7:
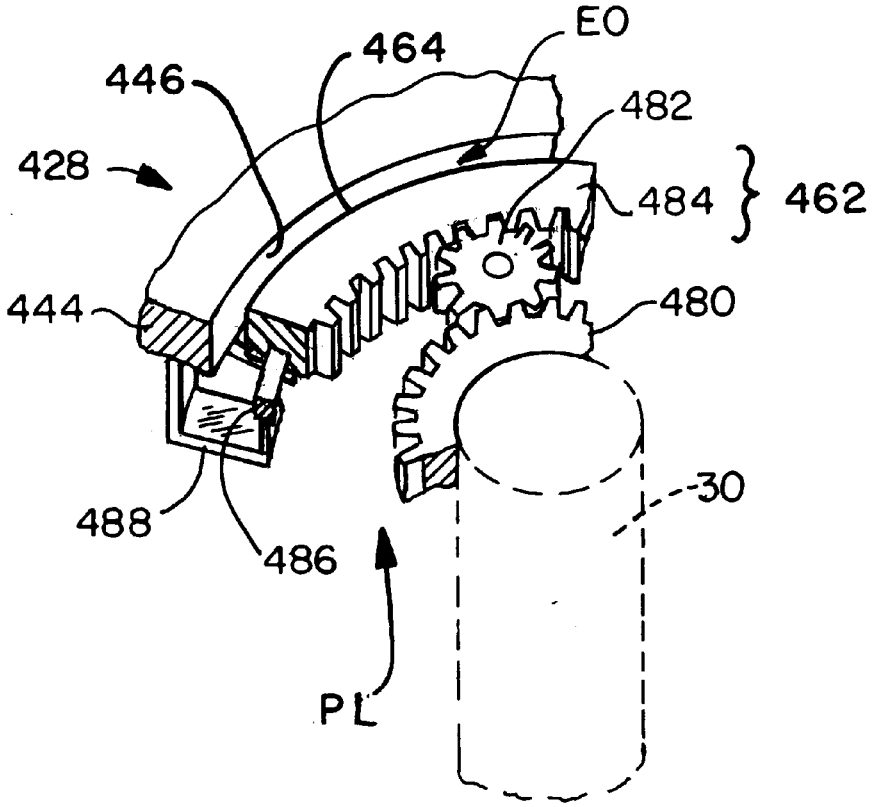
FIG. 7 is a front elevational view, in partial vertical section, of a further additional embodiment of the chamber sealing apparatus of the present invention.

In FIG. 7, a further additional embodiment of the chamber sealing apparatus of the present invention is illustrated and is generally designated as a chamber sealing apparatus 428. The chamber sealing apparatus 428 includes a skirt member 444 having an annular outer edge sealingly connected to the separator body 14 and an annular inner edge 446. The chamber sealing apparatus 428 further includes a shaft associated portion in the form of a shaft skirt 462 having an outer annular edge 464 of a diameter of less than the inner edge 446 of the skirt member 444, whereby the annular gap formed between the edges forms the outlet opening EO of the plenum PL. The chamber sealing apparatus 428 also includes a vane assembly which is not illustrated but which is comprised of a plurality of vanes commonly mounted to a vane support which, in turn, is fixedly mounted to the shaft 30 for driving rotation of the vanes.

The shaft skirt 462 includes three portions which include a drive portion 480 secured to the shaft 30 for rotation therewith, an intermediate gear portion 482, and a driven portion 484. The driven portion 484 is mounted on an annular rail 486, mounted by brackets 488 to the skirt 444, for annular sliding movement of the driven portion 484 therealong. The circumference of the outer circumferential surface of the drive portion 480 is in the form of gear teeth. The circumference of the inner circumferential surface of the driven portion 484 is in the form of gear teeth. The intermediate gear portion 482 includes an intermediate gear which disposed in meshing contact with the gear teeth surfaces of the drive portion 480 and the driven portion 484 such that the drive portion 480, which rotates with the shaft 30, drives the driven portion 484 via the intermediate gear to effect sliding movement of the driven portion 484 along the annular rail 486.

Thus, in accordance with the present invention, there has been provided a chamber sealing apparatus that is operable to prevent or mitigate the migration of fluids such as coal-laden air into a chamber or region of a bowl mill of the type operative for pulverizing material into smaller particles. In addition, in accord with one operational possibility of the chamber sealing apparatus of the present invention, the chamber sealing apparatus is operable in a bowl mill separator body having an upper region in which the grinding table and the grinding rolls are located and in which an upper region pressure condition exists and a lower region separate from the upper region and having a lower pressure condition than the pressure condition of the upper region atmosphere.

According to one aspect of the chamber sealing apparatus of the present invention, there is provided means forming a plenum communicated with the upper and lower regions of the separator body of a bowl mill including means forming at least one inlet opening communicating the plenum and the lower region of the separator body and means forming at least one outlet opening communicating the plenum and the upper region of the separator body. The outlet opening forming means includes a shaft associated portion and a second portion spaced from the shaft associated portion to form the outlet opening therebetween.

A vane assembly is also provided and includes at least one vane and a vane support for supporting the vane for rotation about a vane axis, the vane assembly being disposed relative to the plenum for movement of the at least one vane within the plenum during rotation of the vane about the vane axis. The one aspect of the chamber sealing apparatus of the present invention further includes means interconnecting the vane assembly and a power source for rotatably driving the vane about the vane axis such that air in the plenum is subjected to a pressurization greater than that of the upper region of the separator body at the outlet opening, whereby the rotation of the vane within the plenum draws air from the lower region of the separator body into the plenum via the inlet opening and propels air from the plenum into the upper region of the separator body via the outlet opening.

In accordance with one variation of the one aspect of the chamber sealing apparatus of the present invention, the interconnecting means includes means coupling the vane support to the mill shaft for driving rotation of the vanes about the vane axis by the shaft. According to further features of the one variation of the one aspect of the chamber sealing apparatus of the present invention, the vane axis and the bowl mill shaft axis are the same and the vanes and the shaft co-axially rotate.

According to another variation of the one aspect of the chamber sealing apparatus of the present invention, the shaft associated portion of the outlet opening forming means is a circumferential flange extending radially outwardly from the shaft.

According to further details of this another variation of the one aspect of the chamber sealing apparatus of the present invention, the second portion of the outlet opening forming means includes means forming a surface having an edge extending circumferentially around the shaft at a radial spacing therefrom greater than the radial extent of the shaft associated portion whereby the outlet opening is formed between the edge and the shaft associated portion.

According to further details of each of the variations of the one aspect of the chamber sealing apparatus of the present invention, the shaft forms a portion of the plenum forming means. Additionally, the vane assembly can include a plurality of vanes and the vane support is operable to support the vanes in angularly spaced relation to one another about the vane axis, the vane assembly being disposed relative to the plenum for movement of the vanes within the plenum during rotation of the vanes about the vane axis. Moreover, the vane and the shaft associated portion of the outlet opening forming means can be integrally formed.

According to yet further details of each of the variations of the one aspect of the chamber sealing apparatus of the present invention, the shaft associated portion of the outlet opening forming means can move relative to the shaft. Also, the surface of the shaft can form the shaft associated portion of the outlet opening forming means of the plenum. Furthermore, the shaft associated portion may include an axial extent of the shaft. In contrast, the vane axis may be parallel to and radially offset from the shaft. According to additional details of this feature, the shaft is the power source and power take off means are provided for drivingly interconnecting the shaft and the vane support such that the vanes are drivingly rotated by the shaft.

While one embodiment of the invention has been shown, it will be appreciated that modifications thereof, some of which have been alluded to hereinabove, may still be readily made thereto by those skilled in the art. It is, therefore, intended that the appended claims shall cover the modifications alluded to herein as well as all the other modifications which fall within the true spirit and scope of the present invention.

I claim:

1. In a bowl mill operative for pulverizing material into smaller particles, the bowl mill having a separator body, a grinding table supported on a shaft for rotation within the separator body, at least one grinding roll supported within the separator body so as to be operable to exert a grinding force on material disposed on the grinding table for effecting the pulverization thereof, and the separator body having an upper region in which the grinding table and the at least one grinding roll are located and in which an upper region pressure condition exists and a lower region separate from the upper region and having a lower pressure condition than the pressure condition of the upper region atmosphere, the improvement comprising:

means forming a plenum communicating with the upper and lower regions including means forming at least one inlet opening communicating with the plenum and the lower region of the separator body and means forming at least one outlet opening communicating with the plenum and the upper region of the separator body, the outlet opening forming means including a shaft associated portion and a second portion spaced from the shaft associated portion to form the outlet opening therebetween;

a vane assembly including at least one vane and a vane support for supporting the vane for rotation about a vane axis, the vane assembly being disposed relative to the plenum for movement of the at least one vane within the plenum during rotation of the vane about the vane axis; and means interconnecting the vane assembly and a power source for rotatably driving the vane about the vane axis such that air in the plenum is subjected to a pressurization greater than that of the upper region of the separator body at the outlet opening, whereby the rotation of the vane within the plenum draws air from the lower region of the separator body into the plenum via the inlet opening and propels air from the plenum into the upper region of the separator body via the outlet opening.

2. In a bowl mill operative for pulverizing material into smaller particles, the improvement according to claim 1 wherein the interconnecting means includes means coupling the vane support to the mill shaft for driving rotation of the vanes about the vane axis by the shaft.

3. In a bowl mill operative for pulverizing material into smaller particles, the improvement according to claim 2 wherein the vane axis and the bowl mill shaft axis are the same and the vanes and the shaft co-axially rotate.

4. In a bowl mill operative for pulverizing material into smaller particles, the improvement according to claim 1 wherein the shaft associated portion of the outlet opening forming means is a circumferential flange extending radially outwardly from the shaft.

5. In a bowl mill operative for pulverizing material into smaller particles, the improvement according to claim 4 wherein the second portion of the outlet opening forming means includes means forming a surface having an edge extending circumferentially around the shaft at a radial spacing therefrom greater than the radial extent of the shaft associated portion whereby the outlet opening is formed between the edge and the shaft associated portion.

6. In a bowl mill operative for pulverizing material into smaller particles, the improvement according to claim 1 wherein the shaft forms a portion of the plenum forming means.

7. In a bowl mill operative for pulverizing material into smaller particles, the improvement according to claim 1 wherein the vane assembly includes a plurality of vanes and the vane support is operable to support the vanes in angularly spaced relation to one another about the vane axis, the vane assembly being disposed relative to the plenum for movement of the vanes within the plenum during rotation of the vanes about the vane axis.

8. In a bowl mill operative for pulverizing material into smaller particles, the improvement according to claim 1 wherein the vane and the shaft associated portion of the outlet opening forming means are integrally formed.

9. In a bowl mill operative for pulverizing material into smaller particles, the improvement according to claim 1 wherein the shaft associated portion of the outlet opening forming means moves relative to the shaft.

10. In a bowl mill operative for pulverizing material into smaller particles, the improvement according to claim 1 wherein the surface of the shaft forms the shaft associated portion of the outlet opening forming means of the plenum.

11. In a bowl mill operative for pulverizing material into smaller particles, the improvement according to claim 1 wherein the shaft associated portion of the outlet opening includes an axial extent of the shaft.

12. In a bowl mill operative for pulverizing material into smaller particles, the improvement according to claim 1 wherein the shaft associated portion of the outlet opening includes a generally annular flange coupled with, and radially outwardly extending from, the shaft.

13. In a bowl mill operative for pulverizing material into smaller particles, the improvement according to claim 1 wherein the vane axis is parallel to and radially offset from the shaft.

14. In a bowl mill operative for pulverizing material into smaller particles, the improvement according to claim 13 wherein the shaft is the power source and further including power take off means for drivingly interconnecting the shaft and the vane support such that the vanes are drivingly rotated by the shaft.

* * * * *